US011373565B2

(12) United States Patent
Nie

(10) Patent No.: US 11,373,565 B2
(45) Date of Patent: Jun. 28, 2022

(54) DISPLAY PANEL INCLUDING TEST CIRCUIT IN NON-DISPLAY AREA AND DISPLAY DEVICE

(71) Applicant: Wuhan China Star Optoelectronics Technology Co., Ltd., Hubei (CN)

(72) Inventor: Xiaohui Nie, Hubei (CN)

(73) Assignee: WUHAN CHINA STAR OPTOELECTRONICS TECHNOLOGY CO., LTD., Wuhan (CN)

( * ) Notice: Subject to any disclaimer, the term of this patent is extended or adjusted under 35 U.S.C. 154(b) by 190 days.

(21) Appl. No.: 16/623,717

(22) PCT Filed: Oct. 9, 2019

(86) PCT No.: PCT/CN2019/110047
§ 371 (c)(1),
(2) Date: Dec. 17, 2019

(87) PCT Pub. No.: WO2020/258583
PCT Pub. Date: Dec. 30, 2020

(65) Prior Publication Data

US 2021/0343203 A1 Nov. 4, 2021

(30) Foreign Application Priority Data

Jun. 25, 2019 (CN) ..... 201910553063.2

(51) Int. Cl.
*G09G 3/00* (2006.01)
*G09G 3/20* (2006.01)

(52) U.S. Cl.
CPC ..... *G09G 3/006* (2013.01); *G09G 3/2092* (2013.01)

(58) Field of Classification Search
None
See application file for complete search history.

(56) References Cited

U.S. PATENT DOCUMENTS

2009/0045732 A1* 2/2009 Kwak ..... G09G 3/006 313/504
2016/0247436 A1 8/2016 Lee et al.
2018/0047804 A1* 2/2018 Zhou ..... G09G 3/2092
(Continued)

FOREIGN PATENT DOCUMENTS

CN 105913787 A 8/2016
CN 107683020 A 2/2018
CN 108122804 A 6/2018
(Continued)

*Primary Examiner* — Kirk W Hermann
(74) *Attorney, Agent, or Firm* — Geoffrey Lottenberg; Berger Singerman LLP

(57) ABSTRACT

A non-display area is disposed around a display area, a test circuit of non-display area comprises a plurality of signal lines disposed in parallel along a first direction, a plurality of switch groups are disposed in a same row along a second direction, a connecting signal line and a plurality of transmission line groups, the display area comprises a plurality of pixel groups disposed in parallel along the second direction, the second direction and the first direction are perpendicular to each other, and each of switch groups comprises a first switch and a second switch disposed in the same row along the second direction.

6 Claims, 4 Drawing Sheets

(56) References Cited

U.S. PATENT DOCUMENTS

| | | | |
|---|---|---|---|
| 2019/0116672 | A1 | 4/2019 | Zhao et al. |
| 2021/0055617 | A1 | 2/2021 | Fujikawa |

FOREIGN PATENT DOCUMENTS

| | | | | |
|---|---|---|---|---|
| CN | 108700786 | A | | 10/2018 |
| CN | 208621887 | U | * | 3/2019 |
| KR | 20060017312 | A | | 2/2006 |

* cited by examiner

DISPLAY PANEL INCLUDING TEST CIRCUIT IN NON-DISPLAY AREA AND DISPLAY DEVICE

FIELD OF INVENTION

The disclosure relates to a display technology field, and more particularly to a display panel and a display device.

BACKGROUND OF INVENTION

At present, chip on glass (COG) is a technology that directly fixes a driver IC directly to a display screen through anisotropic conductive film (ACF), which realizes thin and light features of small and medium size display panels.

In the prior art, in the COG technology, the driving IC is crimped to a terminal area within the non-display area of the display panel through the ACF. The terminal area comprises a test circuit, and the test circuit generally comprises a first switch and a second switch arranged in rows. Since the first switch and the second switch are disposed in two rows, the occupied space is larger, which is disadvantageous for the narrow frame design of the display panel.

As mentioned above, it is necessary to provide a display panel and a display device that can increase the screen ratio of the panel to realize the narrow frame design of the display panel.

SUMMARY OF INVENTION

The object of the present disclosure is to provide a display panel and a display device, the first switch and the second switch of the switch groups are parallel with each other along the second direction and are disposed in the same row, to resolve the problem of the prior art that the first switch and the second switch are disposed in two rows, which is disadvantageous for the narrow frame design of the display panel.

To achieve the above object, the present disclosure provides a technical solution as below.

The present embodiment provides a display panel, comprising a display area and a non-display area disposed around the display area; the non-display area comprising a test circuit, the test circuit comprising: a plurality of signal lines disposed in parallel with each other along a first direction, and the plurality of signal lines are used for transmitting a test signal; a plurality of switch groups disposed in a same row along a second direction, each of the plurality of switch groups is in sequence disposed a first switch and a second switch along the second direction disposed parallel with each other and in the same row along the second direction, wherein the second direction and the first direction are perpendicular to each other; a plurality of transmission line groups disposed opposite to the corresponding plurality of switch groups, and the plurality of transmission line groups are connected to the plurality of signal lines and the corresponding plurality of switch groups for transmitting the test signal by the plurality of signal lines to the corresponding plurality of switch groups; the display area comprises a plurality of pixel groups, the plurality of pixel groups are disposed in parallel with each other along the second direction, each of the plurality of pixel groups is in sequence disposed a first pixel and a second pixel, the first pixel and the second pixel are disposed in parallel with each other along the second direction; the test signal is used for performing a performance test on the corresponding first pixel and the second pixel by the plurality of switch groups, or the test signal is used for performing a performance test on the corresponding first pixel or the second pixel by the plurality of switch groups.

In one of embodiment, the plurality of signal lines comprise: a first signal line used for transmitting a first test signal; a second signal line used for transmitting a second test signal; a third signal line used for transmitting a third test signal; wherein, the first signal and the third signal are used for performing a performance test on the first pixel, the second signal and the third signal are used for performing a performance test on the second pixel.

In one of embodiment, the first switch and the second switch both comprise an input terminal, an output terminal, and a control terminal between the input terminal and the output terminal, wherein the first switch and the second switch share the same input terminal; the input terminal of the first switch is used for transmitting the first test signal of the first signal line, the input terminal of the second switch is used for transmitting the second test signal of the second signal line; the control terminal of the first switch is used for transmitting the third test signal of the third signal line, to control the conduction between the input terminal and the output terminal of the corresponding first switch, the control terminal of the second switch is used for transmitting the third test signal of the third signal line, to control the conduction between the input terminal and the output terminal of the corresponding second switch.

When the input terminal and the output terminal of the first switch are conductive, the output terminal of the first switch is used for outputting the corresponding test signal to the corresponding first pixel, when the input terminal and the output terminal of the second switch are conductive, the output terminal of the second switch is used for outputting the corresponding test signal to the corresponding second pixel.

In one of embodiment, the plurality of transmission line groups comprise a plurality of first transmission line groups and a plurality of second transmission line groups disposed alternately in parallel along the second direction, the plurality of first transmission line groups are oppositely disposed to the switch groups in the odd column, the plurality of second transmission line groups are oppositely disposed to the switch groups in the even column.

The plurality of first transmission line groups comprise: a first transmission line connected to the first signal line and the corresponding input terminal of the switch groups in the odd column for transmitting the first test signal of the first signal line to the switch groups in the odd column; a second transmission line connected to the third signal line and the two corresponding control terminals of the switch groups in the odd column for transmitting the third test signal of the third signal line to the switch groups in the odd column.

The plurality of second transmission line groups comprise: a third transmission line connected to the second signal line and the corresponding input terminal of the switch groups in the even column for transmitting the second test signal of the second signal line to the switch groups in the even column; a fourth transmission line connected to the third signal line and the two corresponding control terminals of the switch groups in the even column for transmitting the third test signal of the third signal line to the switch groups in the even column.

In one of embodiment, two output terminals of the switch groups in the odd column are respectively connected to two first pixels adjacent to the second pixel of the corresponding pixel groups, used for performing a performance test on the corresponding two first pixels by using the first test signal and the third test signal; two output terminals of the switch groups in the even column are respectively connected to two second pixels adjacent to the first pixel of the corresponding pixel groups, used for performing a performance test on the corresponding two second pixels by using the first test signal and the third test signal.

In one of embodiment, the first switch and the second switch both comprise an input terminal, an output terminal, and a control terminal between the input terminal and the output terminal; the input terminal of the first switch is used for transmitting the first test signal of the first signal line, and the input terminal of the second switch is used for transmitting the second test signal of the second signal line; the control terminal of the first switch is used for transmitting the third test signal of the third signal line, to control the conduction between the input terminal and the output terminal of the corresponding first switch, the control terminal of the second switch is used for transmitting the third test signal of the third signal line, to control the conduction between the input terminal and the output terminal of the corresponding second switch.

When the input terminal and the output terminal of the first switch are conductive, the output terminal of the first switch is used for outputting the corresponding test signal to the corresponding first pixel, when the input terminal and the output terminal of the second switch are conductive, the output terminal of the second switch is used for outputting the corresponding test signal to the corresponding second pixel.

In one of embodiment, each of the plurality of transmission line groups comprise: a fifth transmission line connected to a first signal line and a first input terminal of the first switch of the corresponding switch groups for transmitting the first test signal of the first signal line to the first switch of the corresponding switch groups; a sixth transmission line connected to a third signal line and a control terminal of the first switch of the corresponding switch groups for transmitting the third test signal of the third signal line to the first switch of the corresponding switch groups; a seventh transmission line connected to a second signal line and a second input terminal of the second switch of the corresponding switch groups for transmitting the second test signal of the second signal line to the second switch of the corresponding switch groups; and an eighth transmission line connected to a third signal line and a control terminal of the second switch of the corresponding switch groups for transmitting the third test signal of the third signal line to the second switch of the corresponding switch groups.

In one of embodiment, the output terminal of the first switch of the switch groups is connected to the first pixel of the corresponding pixel groups and used for performing a performance test on the corresponding first pixel by using the first test signal and the third test signal; the output terminal of the second switch of the switch groups is connected to the second pixel of the corresponding pixel groups and used for performing a performance test on the corresponding second pixel by the second test signal and the third test signal.

In one of embodiment, composition materials of the control terminal, the second transmission line and the fourth transmission line are the same.

In one of embodiment, composition materials of the control terminal, the sixth transmission line and the eighth transmission line are the same.

The present embodiment provides a display device, the display device comprises a display panel, comprising a display area and a non-display area disposed around the display area; the non-display area comprising a test circuit, the test circuit comprising: a plurality of signal lines disposed in parallel with each other along a first direction, and the plurality of signal lines are used for transmitting a test signal; a plurality of switch groups disposed in a same row along a second direction, each of the plurality of switch groups is in sequence disposed a first switch and a second switch along the second direction disposed parallel with each other and in the same row along the second direction, wherein the second direction and the first direction are perpendicular to each other; a plurality of transmission line groups disposed opposite to the corresponding plurality of switch groups, and the plurality of transmission line groups are connected to the plurality of signal lines and the corresponding plurality of switch groups for transmitting the test signal by the plurality of signal lines to the corresponding plurality of switch groups; the display area comprises a plurality of pixel groups, the plurality of pixel groups are disposed in parallel with each other along the second direction, each of the plurality of pixel groups is in sequence disposed a first pixel and a second pixel, the first pixel and the second pixel are disposed in parallel with each other along the second direction; the test signal is used for performing a performance test on the corresponding first pixel and the second pixel by the plurality of switch groups, or the test signal is used for performing a performance test on the corresponding first pixel or the second pixel by the plurality of switch groups.

In one of embodiment, the plurality of signal lines comprise: a first signal line used for transmitting a first test signal; a second signal line used for transmitting a second test signal; a third signal line used for transmitting a third test signal; wherein, the first test signal and the third test signal are used for performing a performance test on the first pixel, the second test signal and the third test signal are used for performing a performance test on the second pixel.

In one of embodiment, the first switch and the second switch both comprise an input terminal, an output terminal, and a control terminal between the input terminal and the output terminal, wherein the first switch and the second switch share the same input terminal; the input terminal of the first switch is used for transmitting the first test signal of the first signal line, the input terminal of the second switch is used for transmitting the second test signal of the second signal line; the control terminal of the first switch is used for transmitting the third test signal of the third signal line, to control the conduction between the input terminal and the output terminal of the corresponding first switch, the control terminal of the second switch is used for transmitting the third test signal of the third signal line, to control the conduction between the input terminal and the output terminal of the corresponding second switch.

When the input terminal and the output terminal of the first switch are conductive, the output terminal of the first switch is used for outputting the corresponding test signal to the corresponding first pixel, when the input terminal and the output terminal of the second switch are conductive, the output terminal of the second switch is used for outputting the corresponding test signal to the corresponding second pixel.

In one of embodiment, the plurality of transmission line groups comprise a plurality of first transmission line groups and a plurality of second transmission line groups disposed alternately in parallel along the second direction, the plurality of first transmission line groups are oppositely disposed to the switch groups in the odd column, the plurality of second transmission line groups are oppositely disposed to the switch groups in the even column.

The plurality of first transmission line groups comprise: a first transmission line connected to the first signal line and the corresponding input terminal of the switch groups in the odd column for transmitting the first test signal of the first signal line to the switch groups in the odd column; a second transmission line connected to the third signal line and the two corresponding control terminals of the switch groups in the odd column for transmitting the third test signal of the third signal line to the switch groups in the odd column.

The plurality of second transmission line groups comprise: a third transmission line connected to the second signal line and the corresponding input terminal of the switch groups in the even column for transmitting the second test signal of the second signal line to the switch groups in the even column; a fourth transmission line connected to the third signal line and the two corresponding control terminals of the switch groups in the even column for transmitting the third test signal of the third signal line to the switch groups in the even column.

In one of embodiment, two output terminals of the switch groups in the odd column are respectively connected to two first pixels adjacent to the second pixel of the corresponding pixel groups, used for performing a performance test on the corresponding two first pixels by using the first test signal and the third test signal; two output terminals of the switch groups in the even column are respectively connected to two second pixels adjacent to the first pixel of the corresponding pixel groups, used for performing a performance test on the corresponding two second pixels by using the first test signal and the third test signal.

In one of embodiment, the first switch and the second switch both comprise an input terminal, an output terminal, and a control terminal between the input terminal and the output terminal; the input terminal of the first switch is used for transmitting the first test signal of the first signal line, and the input terminal of the second switch is used for transmitting the second test signal of the second signal line; the control terminal of the first switch is used for transmitting the third test signal of the third signal line, to control the conduction between the input terminal and the output terminal of the corresponding first switch, the control terminal of the second switch is used for transmitting the third test signal of the third signal line, to control the conduction between the input terminal and the output terminal of the corresponding second switch.

When the input terminal and the output terminal of the first switch are conductive, the output terminal of the first switch is used for outputting the corresponding test signal to the corresponding first pixel, when the input terminal and the output terminal of the second switch are conductive, the output terminal of the second switch is used for outputting the corresponding test signal to the corresponding second pixel.

In one of embodiment, each of the plurality of transmission line groups comprises: a fifth transmission line connected to a first signal line and a first input terminal of the first switch of the corresponding switch groups for transmitting the first test signal of the first signal line to the first switch of the corresponding switch groups; a sixth transmission line connected to a third signal line and a control terminal of the first switch of the corresponding switch groups for transmitting the third test signal of the third signal line to the first switch of the corresponding switch groups; a seventh transmission line connected to a second signal line and a second input terminal of the second switch of the corresponding switch groups for transmitting the second test signal of the second signal line to the second switch of the corresponding switch groups; and an eighth transmission line connected to a third signal line and a control terminal of the second switch of the corresponding switch groups for transmitting the third test signal of the third signal line to the second switch of the corresponding switch groups.

In one of embodiment, the output terminal of the first switch of the switch groups is connected to the first pixel of the corresponding pixel groups and used for performing a performance test on the corresponding first pixel by using the first test signal and the third test signal; the output terminal of the second switch of the switch groups is connected to the second pixel of the corresponding pixel groups and used for performing a performance test on the corresponding second pixel by the second test signal and the third test signal.

In one of embodiment, composition materials of the control terminal, the second transmission line and the fourth transmission line are the same.

In one of embodiment, composition materials of the control terminal, the sixth transmission line and the eighth transmission line are the same.

The present disclosure provide a display panel and a display device, the display and the display device comprises a display and a non-display around the display area, the test circuit of the non-display area comprises a plurality of switch groups are parallel with each other along the second direction and are disposed in the same row, the first switch and the second switch of the switch groups are parallel with each other along the second direction and are disposed in the same row, to reduce a space of the non-display area along the first direction, thereby increasing a screen ratio of the display panel, which is disadvantageous for the narrow frame design of the display panel.

DESCRIPTION OF DRAWINGS

The present invention will be further described below with reference to the drawings as below. The drawings described as below are just some embodiments of the present invention, for the person having ordinary skill in the art, under the premise of no creative labor, the other drawings also can be obtained according to these drawings.

DETAILED DESCRIPTION OF PREFERRED EMBODIMENTS

Figure 1:
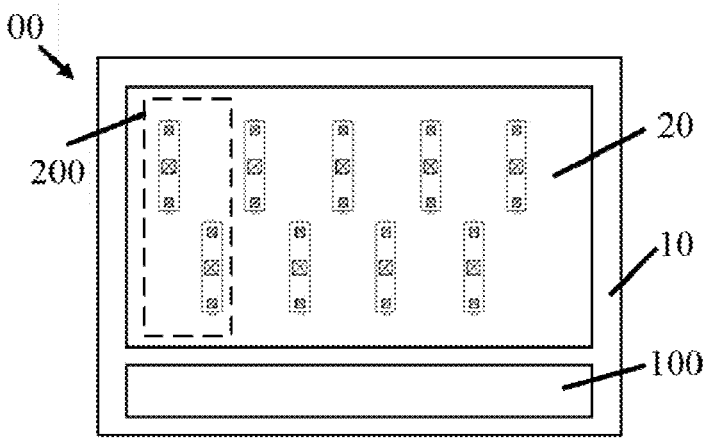
FIG. 1 is a top schematic view of display panel in the present embodiment.

The technical solutions in the embodiments of the present disclosure will be clearly and completely described below in conjunction with the accompanying drawings in the embodiments of the present disclosure. Obviously, the embodiments described are merely a part of the present disclosure, rather than all the embodiments. All other embodiments obtained by the person having ordinary skill in the art based on embodiments of the disclosure, without making creative efforts, are within the scope of the present disclosure.

In the present disclosure, it should be understood that the orientation or positional relationship of terms, such as "upper", "lower", "surface", "vertical", etc. is based on the orientation or positional relationship shown in the drawings. Wherein, "upper" is only the surface above the object, specifically refers to the right above side, the transverse upper side, the upper surface, as same as it is above the object level, and "surface" refers to the direct contact between two objects, the above orientations or positional relationships are merely for the purpose of describing the present invention and simplifying the description, and do not indicate or imply that the device or component referred to must have a specific orientation, constructed and operated in a specific orientation. Therefore, it should not be construed as limiting the invention.

Furthermore, it should also be noted that the drawings provide only the structures and steps that are closely related to the present invention, and omits some details that are not related to the invention, and the purpose is to simplify the drawings and make the invention clear, rather than indicating the actual apparatus and method are exactly the same as the drawings, and are not to be construed as a limitation of the actual apparatus and method.

The present disclosure provides a display device, the display device comprises the display panel of the present embodiment as below.

As shown as FIG. 1, the display panel 00 of present disclosure comprises a display area 20 and a non-display area 10 around display area 20, the non-display area 10 comprises a test circuit 100, the display area 20 comprises a plurality of pixel groups 200.

Figure 2:
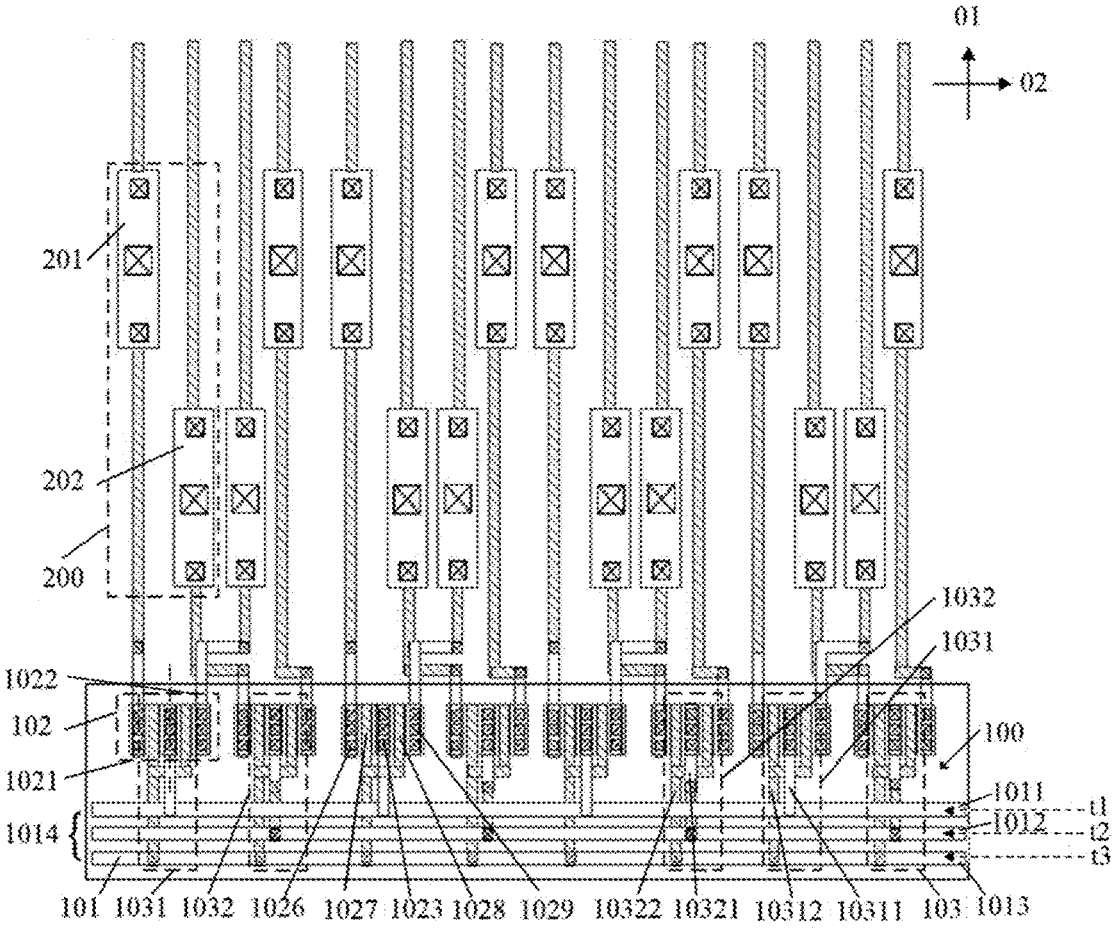
FIG. 2 is a top schematic view of pixel groups and one test circuit of display panel in the present embodiment.
Figure 3:
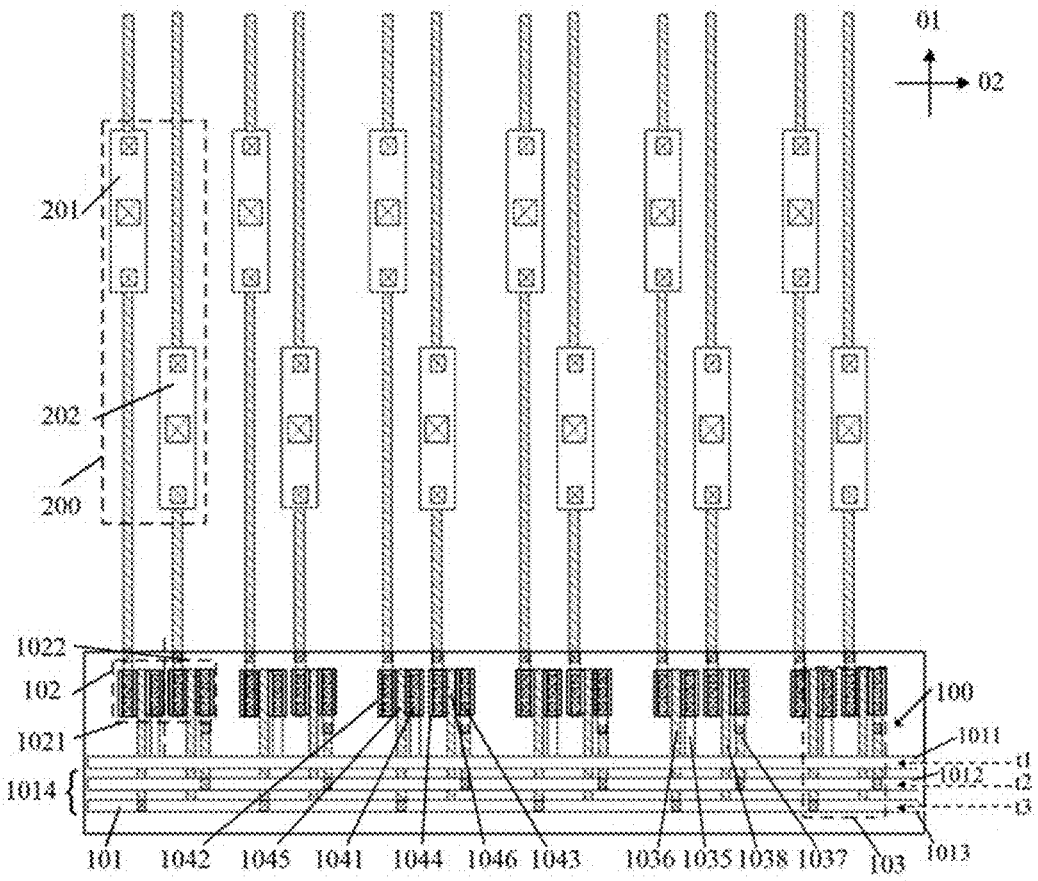
FIG. 3 is a top schematic view of pixel groups and another test circuit of display panel in the present embodiment.

As shown as FIG. 2 and FIG. 3, the test circuit 100 comprises a plurality of signal lines 101, a plurality of switch groups 102 and a plurality of transmission lines 103.

Wherein, the plurality of signal lines 101 are disposed in parallel with each other along a first direction 01 to form a signal line groups 1014, the signal line groups 1014 are used for transmitting a test signal.

Wherein, the switch groups 102 are disposed in the same row along a second direction 02, each of the plurality of switch groups 102 is in sequence disposed a first switch 1021 and a second switch 1022 along the second direction 02, the first switch 1021 and the second switch 1022 are disposed parallel with each other and in the same row along the second direction 02, wherein the second direction 02 and the first direction 01 are perpendicular to each other.

Further, the plurality of switch groups 102 may be disposed parallel with each other along the second direction 02, which can save the space in the second direction 02 of the non-display area 10.

It should be noted that, the first direction 01 and the second direction 02 are for convenience of description, and refer to the direction of the arrow in FIG. 2 and FIG. 3. The first direction 01 is the vertical upward direction in FIG. 2 and FIG. 3, and the second direction 02 is the horizontal right direction in FIG. 2 and FIG. 3, but in the present embodiment, the first direction 01 and the second direction 02 are only required to be perpendicular to each other, and the directions are not limited to the directions in FIG. 2 and FIG. 3.

Wherein, the plurality of transmission line groups 103 are disposed opposite to the corresponding plurality of switch groups 102, and the plurality of transmission line groups 103 are connected to the signal lines 101 and the corresponding switch groups 102 for transmitting the test signal on the signal lines 101 to the corresponding switch groups 102.

It can be understood that the transmission line groups 103 and the switch groups 102 are in one-to-one correspondence, wherein the transmission line groups 103 may be disposed between the signal line groups 1014 and the switch groups 102, further, each of the transmission line groups 103 may be disposed between the signal line groups 1014 and the corresponding switch groups 102, which is convenience that the signal lines 101 are connected to the corresponding switch groups 102.

As shown as FIG. 2 and FIG. 3, the pixel groups 200 are disposed in parallel with each other along the second direction 02, each of the plurality of pixel groups 200 is in sequence disposed a first pixel 201 and a second pixel 202, the first pixel 201 and the second pixel 202 are disposed in parallel with each other along the second direction 02; the test signal is used for performing a performance test on the corresponding first pixel 201 and the second pixel 202 by the switch groups 102, or the test signal is used for performing a performance test on the corresponding first pixel or the second pixel by the plurality of switch groups.

Wherein, the first pixel 201 and the second pixel 202 may be disposed in parallel and in different rows along the second direction 02. For example, the first pixel 201 and the second pixel 202 may be disposed in two rows.

In one embodiment, as shown as FIG. 2, under the premise that the first pixel 201 and the second pixel 202 are parallel with each other and are disposed in two rows along the second direction 02, the first pixel 201 and the second pixel 202 of the adjacent pixel groups 200 may be symmetrically disposed. It can be understood that currently the first pixel 201 and the second pixel 202 in each of the pixel groups 200 are alternately disposed up and down. Therefore, an intersection may be disposed between the first pixel 201 and the second pixel 202 of the same pixel groups 200 along the second direction 02, to save the space of the display area 20, so that more of the pixel groups 200 is disposed in the display area 20, and the resolution of the display panel is improved.

Further, in one embodiment, as shown as FIG. 3, under the premise that the first pixel 201 and the second pixel 202 are parallel with each other and are disposed in two rows along the second direction 02, all of the first pixels 201 may be parallel with each other and disposed in the same row along the second direction 02, and all of the first pixels 202 also may be parallel with each other and disposed in the same row along the second direction 02. It can be understood that currently any adjacent first pixel 201 and second pixel 202 are alternately disposed up and down. Therefore, an intersection may be disposed between the first pixel 201 and the second pixel 202 of the same pixel groups 200 along the second direction 02, to save the space of the display area 20, so that more of the pixel groups 200 is disposed in the display area 20, and the resolution of the display panel is improved.

It can be understood that the embodiment in the FIG. 2 and FIG. 3, under the premise that, the pixel groups 200 comprise one of the first pixel 201 and one of the second pixel 202, since the first pixel 201 and the second pixel 202 of the same pixel groups 200 are disposed up and down, for the same pixel groups 200, the distribution of the first pixel 201 and the second pixel 202 can be made more uniform, and the display uniformity of the display panel is improved.

In one embodiment, as shown as FIG. 2 and FIG. 3, the signal line groups 1014 comprise a first signal line 1011, a second signal line 1012 and a third signal line 1013.

Wherein, the first signal line 1011 is used for transmitting a first test signal t1, the second signal line 1012 is used for transmitting a second test signal t2, the third signal line 1013 is used for transmitting a third test signal t3; the first test signal t1 and the third test signal t3 are used for performing a performance test on the first pixel 201, the second test signal t2 and the third test signal t3 are used for performing a performance test on the second pixel 202.

It should be noted that, the first signal line 1011, the second signal line 1012 and the third signal line 1013 are only required to be disposed parallel with each other along the first direction 01, as for the relative position of the signal lines 101, there is no limitation on the order of arrangement.

In one embodiment, the first switch 1021 and the second switch 1022 each comprise an input terminal, an output terminal, and a control terminal between the input terminal and the output terminal, wherein the first switch 1021 and the second switch 1022 share the same input terminal.

Wherein, the input terminal of the first switch 1021 is used for transmitting the first test signal t1 of the first signal line 1011, the input terminal of the second switch 1022 is used for transmitting the second test signal t2 of the second signal line 1012; the control terminal of the first switch 1021 is used for transmitting the third test signal t3 of the third signal line 1013, to control the conduction between the input terminal and the output terminal of the corresponding first switch 1021, the control terminal of the second switch 1022 is used for transmitting the third test signal t3 of the third signal line 1013, to control the conduction between the input terminal and the output terminal of the corresponding second switch 1022; when the input terminal and the output terminal of the first switch 1021 are conductive, the output terminal of the first switch is used for outputting the corresponding test signal to the corresponding first pixel 201, when the input terminal and the output terminal of the second switch 1022 are conductive, the output terminal of the second switch is used for outputting the corresponding test signal to the corresponding second pixel 202.

Specifically, as shown as FIG. 2, the first switch 1021 may comprise a first output terminal 1026, a first control terminal 1027 and the input terminal 1023 disposed in sequence along the second direction 02, the second switch 2022 comprises the input terminal 1023, a second control terminal 1028 and a second output terminal 1029 disposed in sequence along the second direction 02.

It can be understood that the first switch 1021 and the second switch 1022 are disposed to be in the above symmetric mode, making the first switch 1021 and the second switch 1022 share the same input terminal 1023, which can save the space of the non-display area 10, as for the non-display area 10 could be disposed other elements, and improve the utilization of the non-display area 10, and reduce the manufacturing cost of one of the input terminals 1023 and some of the corresponding transmission line groups 103.

In one embodiment, as shown as FIG. 2, the plurality of transmission line groups 103 comprise a first transmission line groups 1031 and a second transmission line groups 1032 disposed alternately in parallel along the second direction, the first transmission line groups 1031 are oppositely disposed to the switch groups 102 in the odd column, the second transmission line groups 1032 are oppositely disposed to the switch groups 102 in the even column.

It can be understood that the transmission line groups 103 are defined as the first transmission line groups 1031, if it is a transmission line groups in the odd column, the transmission line groups 103 are defined as the first transmission line groups 1032, if it is a transmission line groups in the even column.

Wherein, the first transmission line groups 1031 comprise a first transmission line 10311 and a second transmission line 10312. The first transmission line 10311 is connected to the first signal line 1011 and the corresponding input terminal 1023 of the switch groups 102 in the odd column, for transmitting the first test signal t1 of the first signal line 1011 to the switch groups 102 in the odd column; and the second transmission line 10312 is connected to the third signal line 1013, a first corresponding control terminal 1027 and a second corresponding control terminal 1028 of the switch groups 102 in the odd column, for transmitting the third test signal t3 of the third signal line 1013 to the switch groups 102 in the odd column.

Wherein, the second transmission line groups 1032 comprise a third transmission line 10321 and a fourth transmission line 10322. The third transmission line 10321 is connected to the second signal line 1012 and the corresponding input terminal 1023 of the switch groups 102 in the even column, for transmitting the second test signal t2 of the second signal line 1012 to the switch groups 102 in the even column; and the fourth transmission line 10322 is connected to the third signal line 1013, a first corresponding control terminal 1027 and a second corresponding control terminal 1028 of the switch groups 102 in the even column, for transmitting the third test signal t3 of the third signal line 1013 to the switch groups 102 in the even column.

In one embodiment, as shown as FIG. 2, a first output terminals 1026 and a second output terminal 1029 of the switch groups 102 in the odd column are respectively connected to two first pixels 201 adjacent to the second pixel 202 of the corresponding pixel groups 200, used for performing a performance test on the corresponding two first pixels 201 by using the first test signal t1 and the third test signal t3; a first output terminals 1026 and a second output terminal 1029 of the switch groups 102 in the even column are respectively connected to two second pixels 202 adjacent to the first pixel 201 of the corresponding pixel groups 200, used for performing a performance test on the corresponding two second pixels 202 by using the first test signal t1 and the third test signal t3.

It can be understood that the second direction 02 may comprise: switch groups 102 of the first column, switch groups 102 of the second column, switch groups 102 of the third column, etc., and a first group of pixel groups 200, a second group of pixel groups 200, a third group of pixel groups 200, etc., located above the switch groups 102, wherein the number and position of the pixel groups 200 may one-to-one correspond to the number and position of the switch groups 102.

Specifically, for example, the first output terminals 1026 and the second output terminal 1029 of switch groups 102 of the first column are respectively connected to two first pixels 201 adjacent to the second pixel 202 of the corresponding pixel groups 200, that is the first output terminal 1026 is connected to the first pixel 201 of the corresponding first group of pixel groups 200 and the second output terminal 1029 is connected to the first pixel 201 of the corresponding second group of pixel groups 200; for another example, the second output terminals 1026 and the second output terminal 1029 of switch groups 102 of the first column are respectively connected to two second pixels 202 adjacent to the first pixel 201 of the corresponding pixel groups 200, that is the first output terminal 1026 is connected to the second pixel 202 of the corresponding first group of pixel groups 200 and the second output terminal 1029 is connected to the second pixel 202 of the corresponding second group of pixel groups 200

Based on the above embodiments, the signal flow of the test signal in the present disclosure as below:

The first test signal t1 in sequence passes by the first signal line 1011, the first transmission line 10311, and the input terminal 1023 of the switch groups 102 in the odd column; the third test signal t3 in sequence passes by the third signal line 1013, the second transmission line 10312, the first control terminal 1027 and the second control terminal 1028 of the switch groups 102 in the odd column, so that the same electrical signal is outputted at the first output terminal 1026 and the second output terminal 1029 of the switch groups 102 in the odd column, used for performing a performance test on the corresponding two first pixels 201.

The second test signal t2 in sequence passes by the second signal line 1012, the third transmission line 10321, and the input terminal 1023 of the switch groups 102 in the even column; the third test signal t3 in sequence passes by the third signal line 1013, the fourth transmission line 10322, the first control terminal 1027 and the second control terminal 1028 of the switch groups 102 in the even column, so that the same electrical signal is outputted at the first output terminal 1026 and the second output terminal 1029 of the switch groups 102 in the even column, used for performing a performance test on the corresponding two first pixels 202.

In one embodiment, the first switch 1021 and the second switch 1022 each comprise an input terminal, an output terminal, and a control terminal between the input terminal and the output terminal.

Wherein, about the functions of the input terminal, the output terminal and the control terminal of the first switch 1021 and the second switch 1022, please refer to the description of the previous paragraph "the first switch 1021 and the second switch 1022 share the same input terminal".

It can be understood that as shown as FIG. 3, the difference between the present embodiment and the embodiment 1 of FIG. 2 is that, the first switch 1021 and the second switch 1022 are mutually independent, and do not share the same input terminal; therefore, the relative positions of the first input terminal 1041 and the first output terminal 1042 in the first switch 1021 in the present embodiment, and the relative positions of the second input terminal 1043 and the second output terminal 1044 of the second switch 1022 are not limited, and only the first terminal end 1041 and the first output terminal 1042 are respectively connected to the two sides of the first control terminal 1045, and the second input terminal 1043 and the second output terminal 1044 are respectively connected to the two sides of the second control terminal 1046.

In one embodiment, as shown as FIG. 3, each of the transmission line groups 103 comprises a fifth transmission line 1035, a sixth transmission line 1036, a seventh transmission line 1037 and an eighth transmission line 1038.

Wherein, the fifth transmission line 1035 is connected to a first signal line 1011 and a first input terminal 1041 of the first switch 1021 of the corresponding switch groups 102 for transmitting the first test signal t1 of the first signal line 1011 to the first switch 1021 of the corresponding switch groups 102; the sixth transmission line 1036 is connected to a third signal line 1013 and a first control terminal 1045 of the first switch 1021 of the corresponding switch groups 102 for transmitting the third test signal t3 of the third signal line 1013 to the first switch 1021 of the corresponding switch groups 102; the seventh transmission line 1037 is connected to a second signal line 1012 and a second input terminal 1043 of the second switch 1022 of the corresponding switch groups 102 for transmitting the second test signal t2 of the second signal line 1012 to the second switch 1022 of the corresponding switch groups 102; and an eighth transmission line 1038, the eighth transmission line is connected to a third signal line 1013 and a second control terminal 1046 of the second switch 1022 of the corresponding switch groups 102 for transmitting the third test signal t3 of the third signal line 1013 to the second switch 1022 of the corresponding switch groups 102.

In one embodiment, as shown as FIG. 3, a first output terminal 1042 of the first switch 1021 of the switch groups 102 is connected to the first pixel 201 of the corresponding pixel groups 200, used for performing a performance test on the corresponding first pixel 201 by using the first test signal t1 and the third test signal t3; a second output terminal 1044 of the second switch 1022 of the switch groups 102 is connected to the second pixel 202 of the corresponding pixel groups 200, used for performing a performance test on the corresponding second pixel 202 by using the second test signal t2 and the third test signal t3.

It can be understood that the second direction 02 may comprise: switch groups 102 of the first column, switch groups 102 of the second column, switch groups 102 of the third column, etc., and a first group of pixel groups 200, a second group of pixel groups 200, a third group of pixel groups 200, etc., located above the switch groups 102, wherein the number and position of the pixel groups 200 may one-to-one correspond to the number and position of the switch groups 102; further, the position of the first switch 1021 of the same switch groups 102 corresponds to the position of the first pixel 201 of the corresponding pixel groups 200, the position of the second switch 1022 of the same switch groups 102 corresponds to the position of the second pixel 202 of the corresponding pixel groups 200.

It can be understood that the embodiment of FIG. 3 is compared with the embodiment of FIG. 2, Although the manufacturing cost of switch groups 102 is higher, and the horizontal space of non-display area 100 is occupied more; the connection relationship between the switch groups 102 and the corresponding pixel groups 200 is greatly simplified, which can improve the efficiency of photomask manufacturing and reduce the cost of wiring.

Based on the above embodiments, the signal flow of the test signal in the present disclosure as below:

The first test signal t1 in sequence passes by the first signal line 1011, the fifth transmission line 1035, and the first input terminal 1041 of the first switch 1021 of the switch groups 102, and the third test signal t3 in sequence passes by the third signal line 1013, the sixth transmission line 1036, the first control terminal 1045 of the first switch 1021 of the switch groups 102; so that the same electrical signal is outputted at the first output terminal 1042 of the first switch 1021 of the switch groups 102, used for performing a performance test on the first pixel 201 of the corresponding pixel groups 200.

The second test signal t2 in sequence passes by the second signal line 1012, the seventh transmission line 1037, and the second input terminal 1043 of the second switch 1022 of the switch groups 102, and the third test signal t3 in sequence passes by the third signal line 1013, the eighth transmission line 1038, the second control terminal 1046 of the second switch 1022 of the switch groups 102; so that the same electrical signal is outputted at the second output terminal 1044 of the second switch 1022 of the switch groups 102, used for performing a performance test on the second pixel 202 of the corresponding pixel groups 200.

Figure 4:
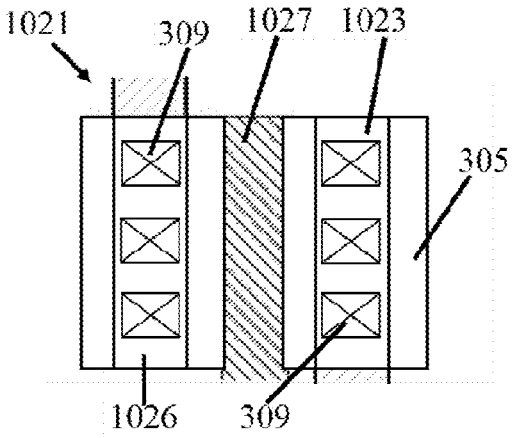
FIG. 4 is a top schematic view of the first switch/the second switch in the present embodiment.

In one embodiment, as shown as FIG. 4, FIG. 4 is an enlarged view of a top view of the first switch 1021. At least one of the first switch 1021 and the second switch 1022 may be a thin film transistor, further, taking the first switch 1021 in FIG. 2 as an example, the input terminal 1023 and the first output terminal 1042 of the first switch 1021 may be respectively the source and the drain of the thin film transistor or may be respectively the drain and source the of the thin film transistor, the first control terminal 1027 of the first switch 1021 may be the gate of thin film transistor. It can be understood that at least one of the first switch 1021 and the second switch 1022 may be other three-terminal switching elements such as triodes, etc.

Figure 5:
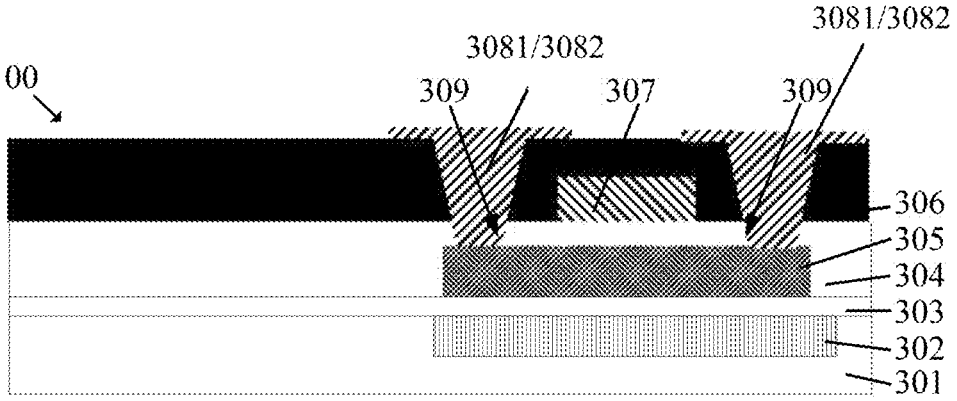
FIG. 5 is a cross-sectional schematic view of the display panel in the present embodiment.

When at least one of the first switch 1021 and the second switch 1022 may be a thin film transistor, in one embodiment, as shown as FIG. 5, FIG. 5 is a cross-sectional schematic view of the display panel, the display panel 00 comprises a substrate layer 301, a light shielding layer 302, a buffer layer 303, a gate insulation layer 304, an active layer 305, an intermediate insulating layer 306, a gate layer 307, a source layer 3081 and a drain layer 3082.

Wherein, the light shielding layer 302 is disposed on the part of substrate layer 301, and the upper surface of the light shielding layer 302 is on the same layer as the upper surface of the substrate layer 301; the buffer layer 303 is disposed on the substrate layer 301; the gate insulation layer 304 is disposed on the buffer layer 303; the active layer 305 is disposed on the part of the gate insulation layer 304, and the lower surface of the gate insulating layer 304 is on the same layer as the lower surface of the active layer 305; the intermediate insulating layer 306 is disposed on the gate insulation layer 304; the gate layer 307 is disposed on the part of the intermediate insulating layer 306, and the lower surface of the gate layer 307 is on the same layer as the lower surface of the interlayer insulating layer 306; the source layer 3081 and the drain layer 3082 are disposed on the interlayer insulating layer 306, and are respectively disposed on the both sides of the gate layer. The interlayer insulating layer 306 and the part of the gate insulation layer 304 is provided with a through-hole 309, the source layer 3081 and the drain layer 3082 are connected to the active layer 305 by the through-hole 309, the number of the through-hole 309 could be set according to the actual situation.

Wherein, the source layer 3081 and the drain layer 3082 may be made of the same material in the same layer.

It can be understood that the gate layer 307 is a patterned filter layer, combined with FIG. 2 shows that, the gate layer 307 may comprise a plurality of the first control terminal 1027 and a plurality of the second control terminal 1028; the source layer 3081 and the drain layer 3082 may be one-time patterned filter layer, and combined with FIG. 2 shows that, the source layer 3081 and the drain layer 3082 may comprise a plurality of the input terminal 1023, a plurality of the first output terminal 1026 and a plurality of the second output terminal 1029.

The same reason is that, combined with FIG. 3 shows that, the gate layer 307 may comprise a plurality of the first control terminal 1045 and a plurality of the second control terminal 1046; the source layer 3081 and the drain layer 3082 may be one-time patterned filter layer, the source layer 3081 and the drain layer 3082 comprise a plurality of the first input terminal 1041 and a plurality of the second input terminal 1043, a plurality of the first output terminal 1042 and a plurality of the second output terminal 1044.

It can be understood that as shown as FIG. 2, the first control terminal 1027 and the second control terminal 1028 need to be connected to the second transmission line 10312 and the fourth transmission line 10322, therefore, the first control terminal 1027, the second control terminal 1028, the second transmission line 10312, and the fourth transmission line 10322 are made of the same conductive material, that can be integrated. As shown in FIG. 3, the first control terminal 1045 and the second control terminal 1046 need to be connected to the sixth transmission line 1036 and the eighth transmission line 1038, therefore, the first control terminal 1045, the second control terminal 1046, the sixth transmission line 1036, and the eighth transmission line 1038 are made of a same conductive material, that can be integrated.

In one embodiment, as shown as FIG. 2 and FIG. 3, the first signal line 1011, the second signal line 1012 and the third signal line 1013 do not intersect, and may be made of the same material in the same layer.

It should be noted that, the signal line of the signal line groups 1014, the transmission line of the transmission line groups 103 and the connection line between the switch groups 102 and the pixel groups 200 should be followed in manufacture: two or more lines at the intersection of the lines should be manufactured in different layers, which avoid the manufacture in the same layer, causing crossover lines to connect to each other, thereby interfering with signal transmission. Further, in order to reduce the number of layers of the manufactured lines, the above lines can be manufactured in two layers, and the two layers are made of different materials to ensure the number of layers and materials of the lines at the intersection.

The beneficial effect of the present disclosure: the present disclosure provide a display panel and a display device, the display and the display device comprises a display and a non-display around the display area, the test circuit of the non-display area comprises a plurality of switch groups are parallel with each other along the second direction and are disposed in the same row, the first switch and the second switch of the switch groups are parallel with each other along the second direction and are disposed in the same row, to reduce a space of the non-display area along the first direction, thereby increasing a screen ratio of the display panel, which is disadvantageous for the narrow frame design of the display panel.

The detail description has been introduced above for a display panel and a structure of a display device comprising the display panel provided by the embodiments of the present disclosure. Herein, a specific case is applied in this article for explain the principles and specific embodiments of the present invention have been set forth. The description of the aforesaid embodiments is only used to help understand the method of the present invention and the core idea thereof; the person having ordinary skill in the art should be realized: they can still modify the technical solutions described in the above embodiments, or equivalently replace some of the technical features; and those modifications and replacements do not detach the scope of the technical solutions of the embodiments of the present disclosure.

What is claimed is:

1. A display panel, comprising a display area and a non-display area disposed around the display area;

the non-display area comprising a test circuit, the test circuit comprising a plurality of signal lines disposed in parallel with each other along a first direction, the plurality of signal lines are used for transmitting test signals;

a plurality of switch groups disposed in a same row along a second direction, each of the plurality of switch groups is in sequence disposed as a first switch and a second switch along the second direction, the first switch and the second switch are disposed parallel with each other and in a same row along the second direction, wherein the second direction and the first direction are perpendicular to each other;

a plurality of transmission line groups disposed opposite to corresponding plurality of switch groups, and the plurality of transmission line groups are connected to the plurality of signal lines and the corresponding plurality of switch groups for transmitting the test signals by the plurality of signal lines to the corresponding plurality of switch groups;

the display area comprises a plurality of pixel groups disposed in parallel with each other along the second direction, each of the plurality of pixel groups is in sequence disposed as a first pixel and a second pixel, the first pixel and the second pixel are disposed in parallel with each other along the second direction;

the plurality of signal lines comprise a first signal line used for transmitting a first test signal; a second signal line used for transmitting a second test signal; and a third signal line used for transmitting a third test signal; wherein, the first test signal and the third test signal are used for testing the first pixel, the second test signal and the third test signal are used for testing the second pixel;

the first switch and the second switch both comprise an input terminal, an output terminal, and a control terminal between the input terminal and the output terminal, wherein the first switch and the second switch share a same input terminal;

the input terminal of the first switch is used for transmitting the first test signal of the first signal line, the input terminal of the second switch is used for transmitting the second test signal of the second signal line; and the control terminal of the first switch is used for transmitting the third test signal of the third signal line, to control conduction between an input terminal and an output terminal of a corresponding first switch, the control terminal of the second switch is used for transmitting the third test signal of the third signal line, to control the conduction between an input terminal and an output terminal of a corresponding second switch, when the input terminal and the output terminal of the first switch are conductive, the output terminal of the first switch is used for outputting a corresponding first test signal to a corresponding first pixel, when the input terminal and the output terminal of the second switch are conductive, the output terminal of the second switch is used for outputting a corresponding second test signal to a corresponding second pixel;

the plurality of transmission line groups comprise a plurality of first transmission line groups and a plurality of second transmission line groups disposed alternately in parallel along the second direction, the plurality of first transmission line groups are oppositely disposed switch groups in an odd column, the plurality of second transmission line groups are oppositely disposed switch groups in an even column;

the plurality of first transmission line groups comprise a first transmission line connected to the first signal line and a corresponding input terminal of the switch groups in the odd column for transmitting the first test signal of the first signal line to the switch groups in the odd column;

a second transmission line connected to the third signal line and two corresponding control terminals of the switch groups in the odd column, for transmitting the third test signal of the third signal line to the switch groups in the odd column;

the plurality of second transmission line groups comprise a third transmission line connected to the second signal line and a corresponding input terminal of the switch groups in the even column for transmitting the second test signal of the second signal line to the switch groups in the even column; and a fourth transmission line connected to the third signal line and two corresponding control terminals of the switch groups in the even column for transmitting the third test signal of the third signal line to the switch groups in the even column.

2. The display panel as claimed in claim 1, wherein two output terminals of the switch groups in the odd column are respectively connected to two first pixels adjacent to a second pixel of corresponding pixel groups, are used for testing corresponding two first pixels by using the first test signal and the third test signal; and two output terminals of the switch groups in the even column are respectively connected to two second pixels adjacent to a first pixel of the corresponding pixel groups, are used for testing corresponding two second pixels by using the first test signal and the third test signal.

3. The display panel as claimed in claim 1, wherein composition materials of the control terminal of the first switch, the control terminal of the second switch, the second transmission line and the fourth transmission line are the same.

4. A display device, wherein the display device comprises a display panel, wherein the display panel comprises a display area and a non-display area disposed around the display area;

the non-display area comprises a test circuit, the test circuit comprises a plurality of signal lines disposed in parallel with each other along a first direction, the plurality of signal lines are used for transmitting test signals;

a plurality of switch groups disposed in a same row along a second direction, each of the plurality of switch groups is in sequence disposed as a first switch and a second switch along the second direction, the first switch and the second switch are disposed parallel with each other and in a same row along the second direction, wherein the second direction and the first direction are perpendicular to each other;

a plurality of transmission line groups disposed opposite to corresponding plurality of switch groups, and the plurality of transmission line groups are connected to the plurality of signal lines and the corresponding plurality of switch groups for transmitting the test signals by the plurality of signal lines to the corresponding plurality of switch groups; and the display area comprises a plurality of pixel groups disposed in parallel with each other along the second direction, each of the plurality of pixel groups is in sequence disposed as a first pixel and a second pixel, the first pixel and the second pixel are disposed in parallel with each other along the second direction;

the plurality of signal lines comprise a first signal line used for transmitting a first test signal; a second signal line used for transmitting a second test signal; and a third signal line used for transmitting a third test signal; wherein, the first test signal and the third test signal are used for testing the first pixel, the second test signal and the third test signal are used for testing the second pixel;

the first switch and the second switch both comprise an input terminal, an output terminal, and a control terminal between the input terminal and the output terminal;

the input terminal of the first switch is used for transmitting the first test signal of the first signal line, and the input terminal of the second switch is used for transmitting the second test signal of the second signal line;

the control terminal of the first switch is used for transmitting the third test signal of the third signal line, to control conduction between an input terminal and an output terminal of a corresponding first switch, the control terminal of the second switch is used for transmitting the third test signal of the third signal line, to control conduction between an input terminal and an output terminal of a corresponding second switch;

when the input terminal and the output terminal of the first switch are conductive, the output terminal of the first switch is used for outputting a corresponding first test signal to a corresponding first pixel, when the input terminal and the output terminal of the second switch are conductive, the output terminal of the second switch is used for outputting a corresponding second test signal to a corresponding second pixel;

each of the plurality of transmission line groups comprises a fifth transmission line connected to a first signal line and a first input terminal of a first switch of a corresponding switch group for transmitting the first test signal of the first signal line to the first switch of the corresponding switch groups;

a sixth transmission line connected to a third signal line and a control terminal of the first switch of the corresponding switch groups for transmitting the third test signal of the third signal line to the first switch of the corresponding switch groups;

a seventh transmission line connected to a second signal line and a second input terminal of a second switch of the corresponding switch groups for transmitting the second test signal of the second signal line to the second switch of the corresponding switch groups; and an eighth transmission line connected to a third signal line and a control terminal of the second switch of the corresponding switch groups for transmitting the third test signal of the third signal line to the second switch of the corresponding switch groups.

5. The display device as claimed in claim 4, wherein:

the output terminal of the first switch of the switch groups is connected to a first pixel of the corresponding pixel groups and used for testing the corresponding first pixel by the first test signal and the third test signal; and the output terminal of the second switch of the switch groups is connected to a second pixel of the corresponding pixel groups, is used for testing the corresponding second pixel by using the second test signal and the third test signal.

6. The display device as claimed in claim 4, wherein composition materials of the control terminal of the first switch, the control terminal of the second switch, the sixth transmission line and the eighth transmission line are the same.

* * * * *